US008899222B2

(12) United States Patent
DeFoort et al.

(10) Patent No.: US 8,899,222 B2
(45) Date of Patent: Dec. 2, 2014

(54) COOK STOVE ASSEMBLY

(75) Inventors: Morgan W. DeFoort, Fort Collins, CO (US); Bryan D. Willson, Fort Collins, CO (US); Nathan Lorenz, Fort Collins, CO (US); Michael P. Brady, Oak Ridge, TN (US); Anthony Marchese, Fort Collins, CO (US); Daniel D. Miller-Lionberg, Fort Collins, CO (US)

(73) Assignees: Colorado State University Research Foundation, Fort Collins, CO (US); UT-Battelle, LLC, Oak Ridge, TN (US)

( * ) Notice: Subject to any disclaimer, the term of this patent is extended or adjusted under 35 U.S.C. 154(b) by 872 days.

(21) Appl. No.: 12/756,386

(22) Filed: Apr. 8, 2010

(65) Prior Publication Data

US 2010/0258104 A1 Oct. 14, 2010

Related U.S. Application Data

(60) Provisional application No. 61/168,538, filed on Apr. 10, 2009.

(51) Int. Cl.

| | |
|---|---|
| ***F24B 3/00*** | (2006.01) |
| ***F24B 1/00*** | (2006.01) |
| ***F24C 1/16*** | (2006.01) |

(52) U.S. Cl.

CPC .. *F24C 1/16* (2013.01); *F24B 1/003* (2013.01)
USPC ..... 126/29; 126/2; 126/9 R; 126/25 R; 126/27; 126/39 M; 420/79

(58) Field of Classification Search

USPC ..... 126/2, 9 R, 25 R, 27, 29, 39 M, 222, 223, 126/224, 225, 505, 506; 420/79
See application file for complete search history.

(56) References Cited

U.S. PATENT DOCUMENTS

| | | | | |
|---|---|---|---|---|
| X26 | * | 9/1840 | Williamson | 126/2 |
| 1,103,736 | A | 5/1870 | Gregory | |

(Continued)

FOREIGN PATENT DOCUMENTS

| | | |
|---|---|---|
| GB | 2371473 | 7/2002 |
| JP | 2002115848 | 4/2002 |

(Continued)

OTHER PUBLICATIONS

International Search Report and Written Opinion dated Jun. 15, 2010, PCT/US2010/030514, 9 pages.

(Continued)

*Primary Examiner* — Jorge Pereiro
(74) *Attorney, Agent, or Firm* — Dorsey & Whitney LLP

(57) ABSTRACT

A combustion chamber, having an upper part and a lower part, may include an annular constriction, in combination with the combustion chamber, to aid in directing partially combusted gases such as carbon monoxide away from the periphery of the combustion chamber back toward its center, and into the flame front. The annular constriction may also impede the flow of partially combusted gases located at the periphery, thus increasing the time these gases spend within the combustion chamber and increasing the likelihood that any products of incomplete combustion will undergo combustion. The combustion chamber may further comprise a dual burner cooktop for directing combustion gases and exhaust to multiple cooking vessels. In further embodiments, the combustion chamber may be made of, lined, or clad with a metal alloy comprising iron, chromium, and aluminum.

17 Claims, 12 Drawing Sheets

(56) References Cited

U.S. PATENT DOCUMENTS

| | | | | | |
|---|---|---|---|---|---|
| 1,419,600 | A | | 6/1922 | Anderson | |
| 1,512,482 | A | | 10/1924 | Patterson | |
| 1,725,974 | A | | 8/1929 | Brautigam et al. | |
| 1,968,088 | A | * | 7/1934 | Mekler | 196/133 |
| 2,383,188 | A | | 8/1945 | Griswold | |
| 2,565,677 | A | * | 8/1951 | Campbell | 431/337 |
| 2,786,463 | A | | 3/1957 | Clarence | |
| 3,126,881 | A | | 3/1964 | Matsky | |
| D214,297 | S | * | 5/1969 | Ihde | D7/332 |
| 3,765,397 | A | | 10/1973 | Henderson | |
| D229,277 | S | * | 11/1973 | Chang | D7/337 |
| 3,851,639 | A | | 12/1974 | Beddoe | |
| 4,034,142 | A | * | 7/1977 | Hecht | 428/678 |
| 4,037,580 | A | | 7/1977 | Angelo | |
| 4,167,207 | A | * | 9/1979 | Rao et al. | 164/9 |
| 4,206,598 | A | * | 6/1980 | Rao et al. | 60/282 |
| 4,257,391 | A | * | 3/1981 | Carin | 126/163 R |
| 4,291,669 | A | * | 9/1981 | Herne, Jr. | 126/83 |
| 4,351,316 | A | * | 9/1982 | Kroll | 126/93 |
| 4,471,751 | A | | 9/1984 | Hottenroth et al. | |
| 4,471,985 | A | | 9/1984 | Mahoney | |
| 4,473,059 | A | * | 9/1984 | Nason | 126/58 |
| 4,480,436 | A | * | 11/1984 | Maclin | 60/796 |
| 4,502,464 | A | | 3/1985 | Figueroa | |
| 4,512,249 | A | | 4/1985 | Mentzel | |
| 4,587,947 | A | | 5/1986 | Tomita | |
| 4,714,659 | A | * | 12/1987 | Lindgren et al. | 428/685 |
| 4,732,138 | A | | 3/1988 | Vos | |
| 4,875,462 | A | | 10/1989 | Armstrong | |
| 4,924,845 | A | | 5/1990 | Johnson et al. | |
| 4,962,696 | A | | 10/1990 | Gillis | |
| 5,002,037 | A | | 3/1991 | Armstrong et al. | |
| 5,024,208 | A | | 6/1991 | Hottenroth et al. | |
| 5,144,939 | A | | 9/1992 | Christopherson | |
| 5,236,787 | A | * | 8/1993 | Grassi | 428/552 |
| 5,267,609 | A | * | 12/1993 | Olsson | 165/133 |
| 5,480,608 | A | | 1/1996 | Tsuda et al. | |
| 5,881,709 | A | * | 3/1999 | Daoust | 126/44 |
| 5,909,729 | A | | 6/1999 | Nowicke, Jr. | |
| 5,958,603 | A | * | 9/1999 | Ragland et al. | 428/595 |
| 6,012,493 | A | * | 1/2000 | Remke et al. | 138/38 |
| 6,016,797 | A | | 1/2000 | Nowicke, Jr. | |
| 6,231,807 | B1 | * | 5/2001 | Berglund | 420/62 |
| 6,314,955 | B1 | | 11/2001 | Boetcker | |
| 6,470,875 | B2 | | 10/2002 | Liu | |
| 6,615,821 | B1 | | 9/2003 | Fisenko | |
| 6,651,645 | B1 | * | 11/2003 | Nunez Suarez | 126/9 R |
| 6,799,632 | B2 | * | 10/2004 | Hall et al. | 166/207 |
| D512,264 | S | * | 12/2005 | May et al. | D7/337 |
| 7,167,642 | B1 | * | 1/2007 | Wagner | 392/441 |
| 7,469,489 | B2 | * | 12/2008 | Lewin | 34/380 |
| D640,497 | S | * | 6/2011 | Lorenz et al. | D7/337 |
| 8,025,984 | B2 | * | 9/2011 | Stamm | 428/678 |
| 2003/0234014 | A1 | | 12/2003 | Fitzgerald | |
| 2004/0020659 | A1 | * | 2/2004 | Hall et al. | 166/380 |
| 2005/0229916 | A1 | | 10/2005 | Fitzgerald | |
| 2007/0042304 | A1 | * | 2/2007 | Lewin | 431/154 |
| 2009/0025703 | A1 | * | 1/2009 | Van Der Sluis et al. | 126/1 R |
| 2009/0165769 | A1 | * | 7/2009 | Van Der Sluis | 126/15 A |
| 2010/0083946 | A1 | * | 4/2010 | Cedar et al. | 126/25 B |
| 2010/0258104 | A1 | | 10/2010 | Defoort et al. | |

FOREIGN PATENT DOCUMENTS

| | | | | |
|---|---|---|---|---|
| WO | WO 2006132556 | A1 | * | 12/2006 |
| WO | 2009070952 | | | 6/2009 |

OTHER PUBLICATIONS

International Search Report and Written Opinion dated Feb. 2, 2011, Application No. PCT/US20108056790, 9 pages.

* cited by examiner

COOK STOVE ASSEMBLY

RELATED APPLICATIONS

The present application claims benefit of priority under 35 U.S.C. §119(e) to U.S. Provisional Application No. 61/168,538, filed Apr. 10, 2009. The present application is related to U.S. Provisional Application No. 61/261,694, filed Nov. 16, 2009.

STATEMENT REGARDING FEDERALLY SPONSORED RESEARCH OR DEVELOPMENT

The United States Government has rights in this invention pursuant to contract number DE-AC05-00OR22725 between the United States Department of Energy and UT-Battelle, LLC.

FIELD OF INVENTION

The present invention relates generally to stoves and cooking apparatus for use in confined areas.

BACKGROUND

In many parts of the world, heating and cooking are performed using combustible biomaterial as a fuel source. Combustion with this type of fuel often is incomplete leading to production of poisonous gases, especially carbon monoxide. Within a living or enclosed space, use of biomaterials carbon monoxide may build-up causing sickness or death.

Carbon monoxide (CO) is a colorless, odorless, tasteless toxic gas produced by incomplete combustion in fuel-burning. CO poisoning may result in headaches, nausea, dizziness, or confusion. Left undetected, CO exposure can be fatal, and in the United States alone, accidental CO poisoning results in about 15,000 ER visits a year.

Because carbon monoxide is a byproduct of incomplete combustion, procedures that enhance combustion will reduce the production of carbon monoxide. Those of skill in the art will understand that enhancing combustion may generally be accomplished in three ways—by increasing the duration of combustion, raising the temperature at which combustion takes place, or optimizing the mixing of oxygen and fuel. Another contributor to incomplete combustion may be the presence of a heat sink that may quench combustion. In general, it is easier to control these factors when a gaseous fuel is burned as opposed to a solid fuel. Thus, in developed countries, solid fuel has been largely replaced by gaseous fuels for household use. But, as is evident from the carbon monoxide poisoning statistics presented above, even in the United States, improperly maintained natural gas or propane burners may produce significant amounts of carbon monoxide.

Carbon monoxide may be produced by combustion even under controlled conditions using modern appliances. For this reason, modern must be carefully engineered to properly mix air with gas and modern appliances are generally vented to allow exhaust to be directed out of the house. In contrast, in other countries, it is not uncommon for households to employ unvented, solid fuel biomass stoves for heating and cooking. Use of biomass creates a significant risk if the stove is used within the living quarters or an enclosed space.

Outside the United States, the predominant combustible material for household energy production come from solid fuels such as biomaterial (for example, without wishing to be limited, pelletized or compressed waste or wood, wood chips, coal, dung or other organic materials such as twigs, grasses, or rice husks). For example, it is estimated that over 70% of African households and 80% of Chinese households burn solid fuels for domestic energy needs. As described above, when solid fuel, especially wood, is burned in confined or poorly ventilated spaces, carbon monoxide levels may build to dangerous levels. It has been estimated that between 1.5 and 2 million people die each year as a result of exposure to indoor air pollution resulting from the use of solid fuels.

Poverty is one of the largest contributing factors to the use of solid biomaterial as a fuel source. For example, studies have shown that per capita gross national product (GNP) is closely correlated with dependence on biomass: countries with lower per capita GNP tend to rely on traditional fuel sources far more than countries with higher GNP. Thus, any solution to the problem of indoor air pollution from the combustion of solid fuels must be both cost effective and must not dramatically impact traditional behavior.

Various stove designs are available that may lessen the risk of using biomass for heating or cooking indoors. These stoves attempt to increase stove efficiency, and thus decrease pollution. Some stoves may be constructed of traditional materials such as brick, stone, or ceramics. Other stoves may be constructed of metal. Some stoves are designed to be constructed with either traditional or modern materials, such as, for example without limitation, "rocket" stoves. Rocket stoves employ an "L" design to control the combustion of fuel and mixing of air. In many rocket stoves, fuel, for example twigs, is slowly introduced to the combustion chamber at the bottom of the L. This slow addition of fuel helps to limit the rate of combustion by confining burning to the tips of the sticks. Rocket stove design may include insulation of the chimney to decrease quenching of combustion by cooler surfaces. Some stoves may be designed with a constant radius for both the upper and lower combustion chamber. While rocket stoves may be designed to control air flow passively, other stove designs use electric fans to force air through.

Gasification stove design may rely on passive air flow but more often employs forced air from electric fans to increase stove efficiency. Gasification stoves, (variously known as fan-stoves, semi-gasification stoves, etc.) offer an alternative to traditional stove designs. Gasification stoves replace direct combustion of biomass fuel with techniques that release volatile gases, which are then ignited separately. Gasification is a process that converts carbon containing materials, such as, for example without limitation, coal, petroleum, biomaterial, or biomass, into carbon monoxide and hydrogen by reacting the raw material at high temperatures with a controlled amount of oxygen and/or steam. The resulting gas mixture is itself a fuel and can be combusted. This process may reduce pollution by reducing incomplete combustion and the amount of material needed to fuel the stove.

Gasification techniques are potentially more efficient than direct combustion of the original fuel because it can be combusted at higher temperatures. In addition, the high-temperature combustion may refine out more corrosive elements such as chloride and potassium, allowing relatively cleaner combustion in some cases as well as higher efficiency. However, gasification stoves may be more difficult to construct than some other types of stoves, and therefore more expensive to produce.

To reduce costs of a solid fuel stove for household use and make it accessible to low income persons, requires that the materials used in its construction be inexpensive and that the manufacturing process be efficient and low cost. This is difficult because the combustion environment associated with the use of solid fuels is extreme, both in temperature and corrosiveness. Among other compounds, combustion of biomass produces highly corrosive nitrogen and sulfur compounds.

The combustion environment found in biomass stoves is unsuitable for most low-cost metals, therefore many stoves are constructed of ceramics, brick, or rock. The use of ceramic, brick, and rock, while reducing the cost of manufacture, may dramatically increase the cost of producing and distributing these stoves, decrease their durability, portability, limit combustion chamber geometry and may otherwise be undesirable.

Thus what is needed is a stove that is acceptable and accessible to persons with limited income, such as a stove that lessens the amount of toxic emissions, and may be produced from lightweight, inexpensive, corrosion-resistant materials, and that may be inexpensively and efficiently manufactured.

SUMMARY OF THE INVENTION

Many manufactured stoves, designed for use with solid fuels, are not specifically designed to lessen production of dangerous combustion products. Those manufactured stoves that do address indoor pollution are generally not ideal, either because they rely on drastic changes in traditional behavior (such as limiting use of solid fuels, moving the stoves out of doors, or depending on expensive or impractical venting), or they are financially out of reach for those with modest incomes. A cooking/heating alternative that is compatible with traditional behavior, inexpensive, and capable of lessening production of dangerous gases, may help prevent death and disease especially among persons of limited income.

A stove design is provided that reduces the amount of, at least, carbon monoxide gas emitted from burning a solid fuel energy source, especially biomass. The stove design may be used in either heating or cooking stoves. The inventive design comprises a combustion chamber with two parts, a first, lower combustion chamber and a second, upper combustion chamber. The lower combustion chamber may be configured to receive a solid biomass fuel. The upper combustion chamber may contain an annular constriction positioned within the second, generally cylindrical, upper combustion chamber. The constriction is designed to aid in completely combusting combustion gases as they travel through the upper combustion chamber by slowing the exit of incompletely combusted gases, re-directing uncombusted gases toward the center of the upper combustion chamber and into a flame, and by creating a hot surface that promotes combustion. In various embodiments, the constriction may comprise an orifice ring.

In many embodiments, the inventive design of the lower combustion chamber is a variety of shapes such as cylindrical, or pie shaped depending on the type of fuel used and the stove's intended purpose. A fuel grate or grill may be positioned within the lower combustion chamber to receive solid fuel. Solid fuel may be positioned, ignited, and partially or fully consumed within the lower combustion chamber. Flames and gases may be further consumed within the upper part and the resulting heat and exhaust gases directed out of the upper combustion chamber and toward a cooking vessel.

In various embodiments, constricting the flow of flames and gasses in the upper combustion chamber with an orifice ring, redirects partially combusted or uncombusted gases, such as for example, carbon monoxide, away from the wall of the upper part of the combustion chamber, back toward the center and into the flame where it may be consumed. The orifice ring may also create turbulence above the ring, so that gases near the wall of the upper combustion chamber remain in the upper combustion chamber longer, increasing the likelihood that they may be consumed before exiting the combustion chamber. The orifice ring may be positioned throughout the upper combustion chamber and more than one orifice ring may be positioned within the upper combustion chamber. In constricting the exhaust flow, redirecting it into the flame, and delaying its exit from the upper part of the combustion chamber, the orifice helps to reduce the amount of incompletely combusted gases produced. Thus, the inventive structure may help reduce the amount of at least carbon monoxide produced during heating or cooking by enhancing combustion of uncombusted, partially combusted, and dangerous gases within the upper part of the combustion chamber, reducing fuel use, and increasing energy efficiency As described here, placement of the constriction or orifice ring within the upper combustion chamber helps to redirect and retard incompletely combusted gases, so that they might complete combustion before exiting the upper part of the combustion chamber. Solid fuel, especially biomaterial, is placed in the lower part combustion chamber and ignited. As the fuel burns, exhaust (comprising combustion gases, entrained air, particulate matter, as well as incompletely combusted gases) is formed and enters the upper part of the combustion chamber. The exhaust at the center of the second part continues to undergo combustion as it traverses the upper part of the combustion chamber, but combustion may be quenched near the walls of the upper combustion chamber leading to buildup of incompletely and uncombusted gases. However, these gases may be redirected into the hotter center of the upper part of the combustion chamber, or the flame, by the orifice ring and therefore may complete combustion.

Incompletely combusted gases that get by the orifice plate without being consumed have another chance to undergo combustion as their progress through the upper combustion chamber is retarded by the turbulence and/or recirculation produced above the constriction or orifice ring. To further reduce quenching by the upper part of the combustion chamber, the presently disclosed combustion chamber may be insulated by addition of various materials. For example without limitation, in some embodiments the insulating material may be stone, dirt, sand, clay, quarried materials, or a mixture thereof. In some embodiments, the quarried material may be, for example without limitation, perlite or vermiculite.

As the exhaust exits the upper combustion chamber it may be used to heat a cooking vessel placed atop a stove cooktop which may be in communication with the combustion chamber outlet. Because many households throughout the world use solid fuel in cooking and heating, even in confined spaces, the inventive device will help to lower, at least, levels of carbon monoxide and thus lessen the chances of death and disease resulting from carbon monoxide poisoning.

One of the many applications of the inventive structure is as part of an inexpensive, portable stove. When used in such a stove application the inventive structure may help reduce carbon monoxide production by as much as 60%.

In accordance with another embodiment a multi-burner cooktop is provided. The inventive stove may include a cooktop that sits atop the stove and directs exhaust from the combustion chamber to more than one opening such that multiple cooking vessels may be warmed at once. This inventive cooktop is designed to partially fit into the combustion chamber outlet and redirect heated exhaust through an exhaust chamber in communication with the two openings at the cooktop. The inventive cooktop may also have a third opening designed to allow exhaust gases to exit the exhaust chamber. In some embodiments, the third opening may be designed with a collar to receive an exhaust stovepipe or vent.

In accordance with another embodiment, a metal alloy for use in the manufacture of a corrosion resistant combustion chamber for a stove is provided. The inventive combustion chamber lessens the cost of producing the stove and increases its durability in the extreme conditions found in biomass fuel consumption. The corrosion-resistant alloy is low cost compared to other corrosion resistant metals. Further, unlike corrosion resistant ceramic materials, the alloy reduces the weight of a stove manufactured with the alloy and therefore the cost of producing and shipping the stove. The alloy can be used in a wide range of heating and cooking stoves. For example, without limitation, the alloy may be used to produce rocket stoves, fan stoves, gasification stoves, coal stoves, and charcoal stoves.

in various embodiments, the metal alloy, includes iron (Fe), chromium (Cr), aluminum (Al). The alloy may be referred to as FeCrAl, and may also include other elements such as carbon and titanium. While FeCrAl is well known in the art as a metal alloy for use generally in non-structural applications such as wires or heating elements. FeCrAl has not been used in the construction of stoves, because it dramatically loses tensile strength at elevated temperatures. Rather, FeCrAl is often chosen for applications based on its superior electrical resistivity. Other characteristics of FeCrAl, such as for example, weldability, may be similar to other iron containing metals.

In the presently disclosed stove, FeCrAl is used to clad, line, or form the combustion chamber. However, FeCrAl may be used to clad, line, or form the combustion chamber of other types of stoves including, without limitation, rocket stoves, fan stoves, gasification stoves, semi-gasification stoves, coal stoves, and charcoal stoves.

DETAILED DESCRIPTION

Figure 1:
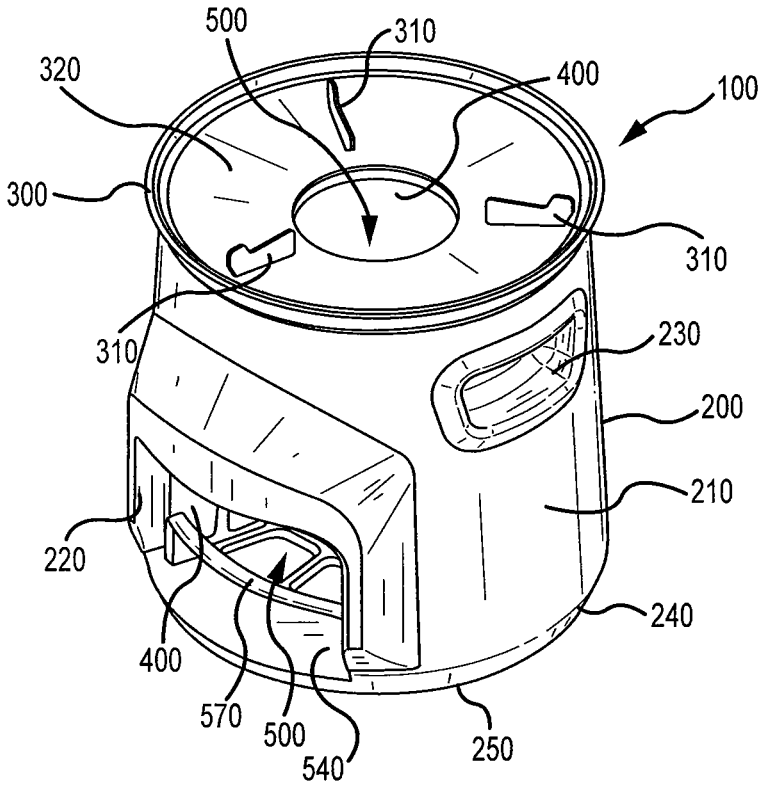
FIG. 1 is a front perspective view of a stove.

FIG. 1 shows a stove 100 for use with the currently disclosed invention. The stove 100 may comprise a housing 200 and a cooktop 300. The cooktop 300 may be seated atop the housing 200 and provide a structures 310 and a surface 320 for positioning and supporting a cooking vessel (not shown). The housing 200 may further comprise an external shell 210, a mouth 220, and an internal liner 400. As seen in FIG. 1, the external shell 210 may include handles 230 to aid in grasping and/or transporting the stove. The external shell 210 may further define a lower base 240 portion and a bottom 250. The bottom 250 may be designed to contact the ground or other support. In some embodiments the mouth 220 may be positioned near the lower base 240 of the shell 210. In some embodiments, the mouth 220 opening may be covered by a door (not shown).

The internal liner 400 may further define a combustion chamber 500, with openings at the mouth 220 and the surface 320 of the cooktop 300. Positioned within the combustion chamber 500, and visible through the mouth 220, may be a grate 570. The grate 570 may sit atop a slab 540, which is positioned within the combustion chamber 500 and also visible through the mouth 220.

Figure 2:
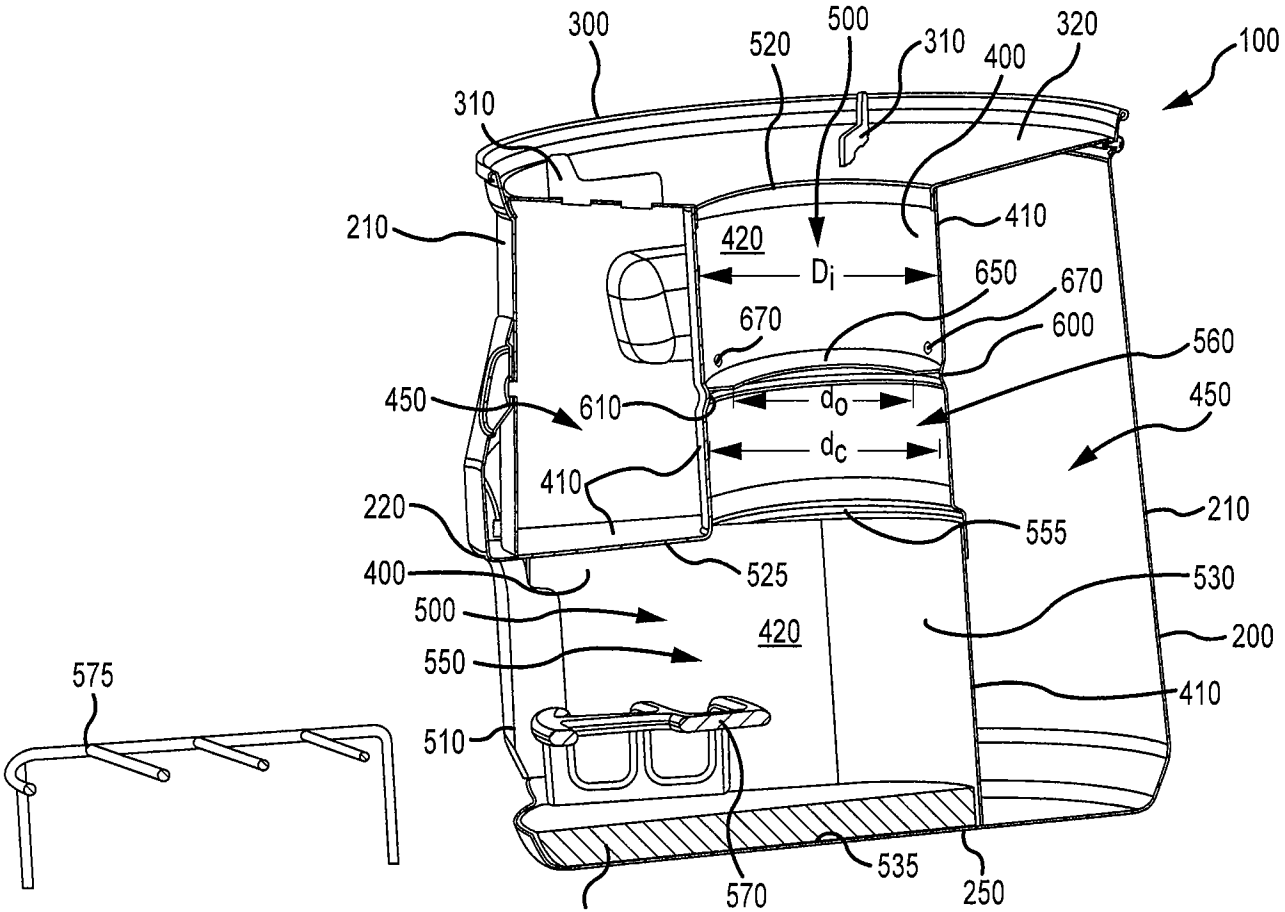
FIG. 2 is a transparent perspective view of the stove liner including the combustion chamber and orifice ring.

FIG. 2 shows the stove 100 in sectional view. The combustion chamber 500 within the stove 100 is formed by the liner 400. The liner may include an exterior surface 410 and an interior surface 420. The interior surface 420 of the liner 400 defines the combustion chamber 500 with an inlet 510 and an outlet 520. The inlet 510 is defined by the mouth 220. The mouth 220 may be closed by a door (not shown), that may reduce access to the combustion chamber 500. The combustion chamber outlet 510 defines an opening through the cooktop 300. The exterior surface 410 of the liner 400 and the housing 200 may define a cavity 450. The cavity 450 may be partially or fully filled with insulation material, such as without limitation, sand, stone, dirt, clay, quarried materials, or a mixture thereof. In some embodiments, the quarried material may be, for example without limitation, perlite, or vermiculite.

Figure 3:
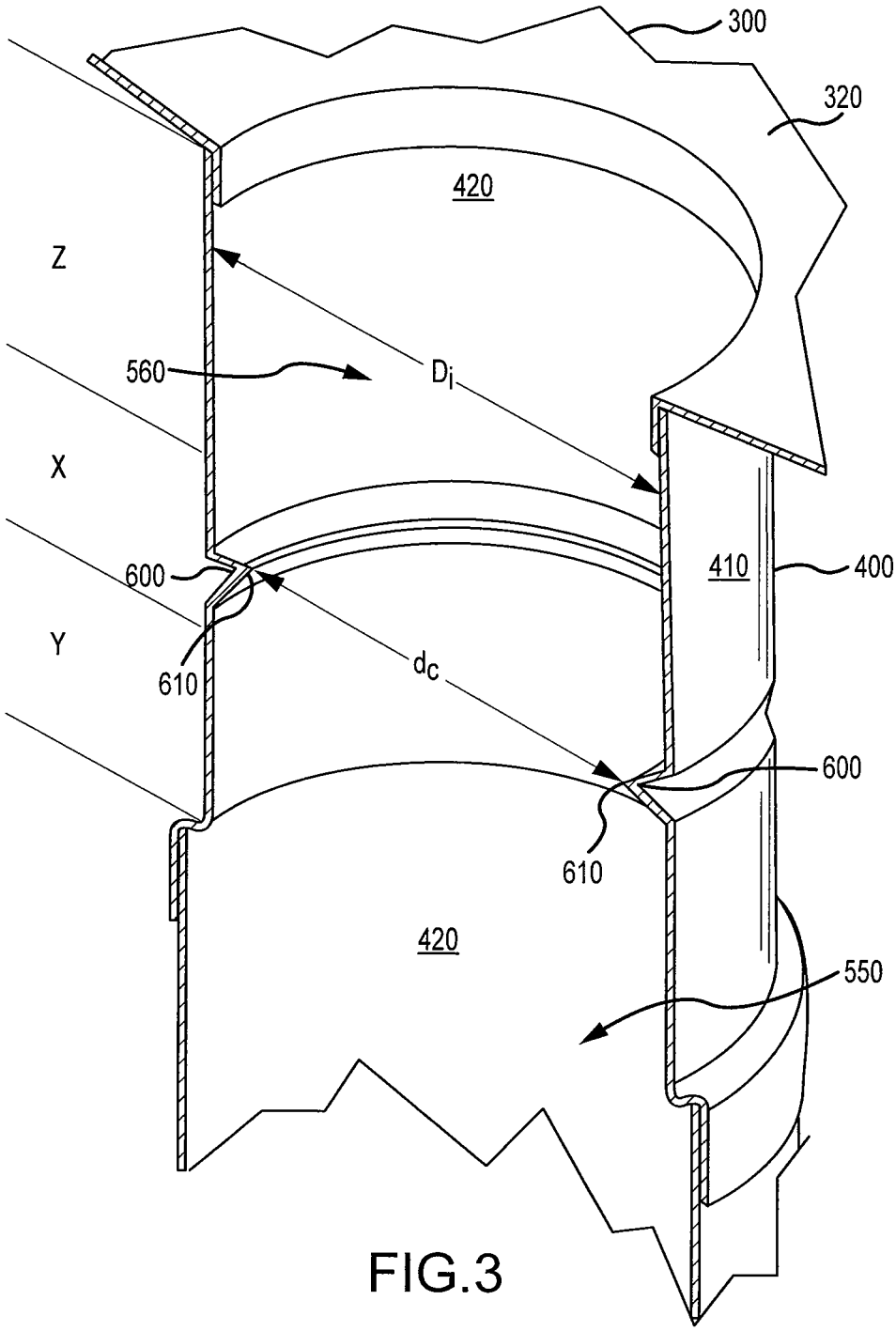
FIG. 3 shows an alternative embodiment of the stove wherein the constriction in the upper combustion chamber is formed by an annular ridge in the wall.

The combustion chamber 500 may further define a lower combustion chamber 550 and an upper combustion chamber 560. The lower combustion chamber 550 may include a floor 535, a ceiling 525, and a sidewall 530. The sidewall 530, floor 535 and ceiling 525 may define the mouth 220 opening in the shell 210. The sidewall 530 may be comprised of a single piece and have a generally pie-shape. In the embodiment shown in FIGS. 1 and 2, the lower combustion chamber 550 comprises a wider opening at the mouth 220 that tapers away from the mouth 220 to the boundary 555 with the upper combustion chamber 560. In various embodiments, the pie-shaped lower combustion chamber 550 may help to provide room for the solid fuel and may also provide for adequate mixing of air. In other embodiments the lower combustion chamber 550 may take various shapes. In other embodiments, the sidewall 530 may define a plurality of wall structures. The floor 535 of the lower combustion chamber 550 may rest upon and be supported by the bottom 250 of the shell 210. In FIGS. 2 and 3, a slab 540 is visible that is supported by the combustion chamber floor 535. The slab 540 may be clay, stone, or some other suitable material, and it may be shaped to match the shape of the floor 535 of the combustion chamber 500.

The grate 570 may be placed within the lower combustion chamber 550 and be supported by the slab 540. The grate 570 may be used to support solid fuel and may be constructed of, for example without limitation, mild steel. Solid fuel may include for example without limitation, coal, wood, charcoal, dung, leaves, grasses, pellets, wood chips, compressed or uncompressed biowaste, or other biomass material. A second, exterior grate 575, shown in FIG. 2, may be positioned outside the stove 100 in front of the mouth 220. The exterior grate 575 may be supported by the ground, and define a surface generally planar with the surface defined by the grate 570 positioned within the lower combustion chamber 550. The exterior grate 575 may be designed to support sticks, twigs, or other long fuel that extends from within the lower combustion chamber 550 outside the mouth 220. Other embodiments may have a plurality of mouths, formed as apertures that may or may not be large enough to accommodate fuel and may be predominantly designed to allow air to enter into the combustion chamber 500. This is described in detail below with respect to gasification stove embodiments (See FIG. 11).

The second, upper combustion chamber 560 may be positioned generally above the lower combustion chamber 550. The lower combustion chamber 550 and the upper combustion chamber 560 are in communication at a boundary 555. The upper combustion chamber 560 may be generally cylindrical. The upper combustion chamber 560 may be in communication with the cooktop 300 at the combustion chamber outlet 520. In some embodiments, both the upper and lower combustion chamber may be generally cylindrical. In other embodiments as depicted in FIG. 1, the upper combustion chamber 560 may differ in shape from the lower combustion chamber 550.

As described in more detail below, alternative embodiments of the stove may lack a mouth, and the upper and lower combustion chambers may both be generally cylindrical. In these alternative embodiments, the boundary between the upper and lower combustion chambers may lack obvious delineation.

The presently disclosed combustion chamber 500 may be constructed of several sections, parts, or pieces. As depicted in FIG. 2 (and in greater detail in FIGS. 3, 4 and 8, below) the section defining the upper combustion chamber 560 sits atop a section(s) that defines the lower combustion chamber 550. Here, the upper combustion chamber 560 piece extends, at least in part, behind and below the top edge of the sidewall 530 of the lower combustion chamber 550. Here also, the ceiling of the lower combustion chamber 550 may be a separate section from the section that defines the sidewall(s) 530 of the lower combustion chamber 550. The ceiling of the lower combustion chamber 550, like the upper combustion chamber 560 piece, extends behind and below the top edge of the wall 530 of the lower combustion chamber 550. The upper combustion chamber 560 piece is supported by at least part of the ceiling of the lower combustion chamber 550. The sections or parts may be held together by corresponding tabs and slots, or may be spot welded. In various embodiments different methods are employed to connect the sections, parts, or pieces. In further embodiments as previously discussed, the combustion chamber 500 may be comprised of a single contiguous piece.

Also depicted in FIG. 2, the upper combustion chamber 560 may define a plurality of generally annular constrictions 600 that may reduce the cross-sectional area of the upper combustion chamber 560. The constriction 600 may define an annular ridge 610 within the interior of the upper combustion chamber 560 that defines a diameter, $d_c$, or the constriction diameter, which reduces the interior diameter, $D_i$, of the combustion chamber 500.

In the present embodiment, as shown in FIG. 2, the constriction 600 may support an orifice ring 650. The orifice ring 650 may also be referred to as a plate. The orifice ring 650 may define an inner diameter, $d_o$. In some embodiments, as shown in FIG. 3, the annular ridge 610 defining the constriction 600 of the upper combustion chamber 560 is much greater, and may alone define the constriction diameter, $d_c$, similar to that defined by the orifice ring, $d_o$, obviating the need for an orifice ring 650. In various embodiments, the constriction 600 of the upper combustion chamber 560 defines an annular ridge 610 with a generally flat or planar upper surface and a generally flat or planar lower surface.

Figure 4:
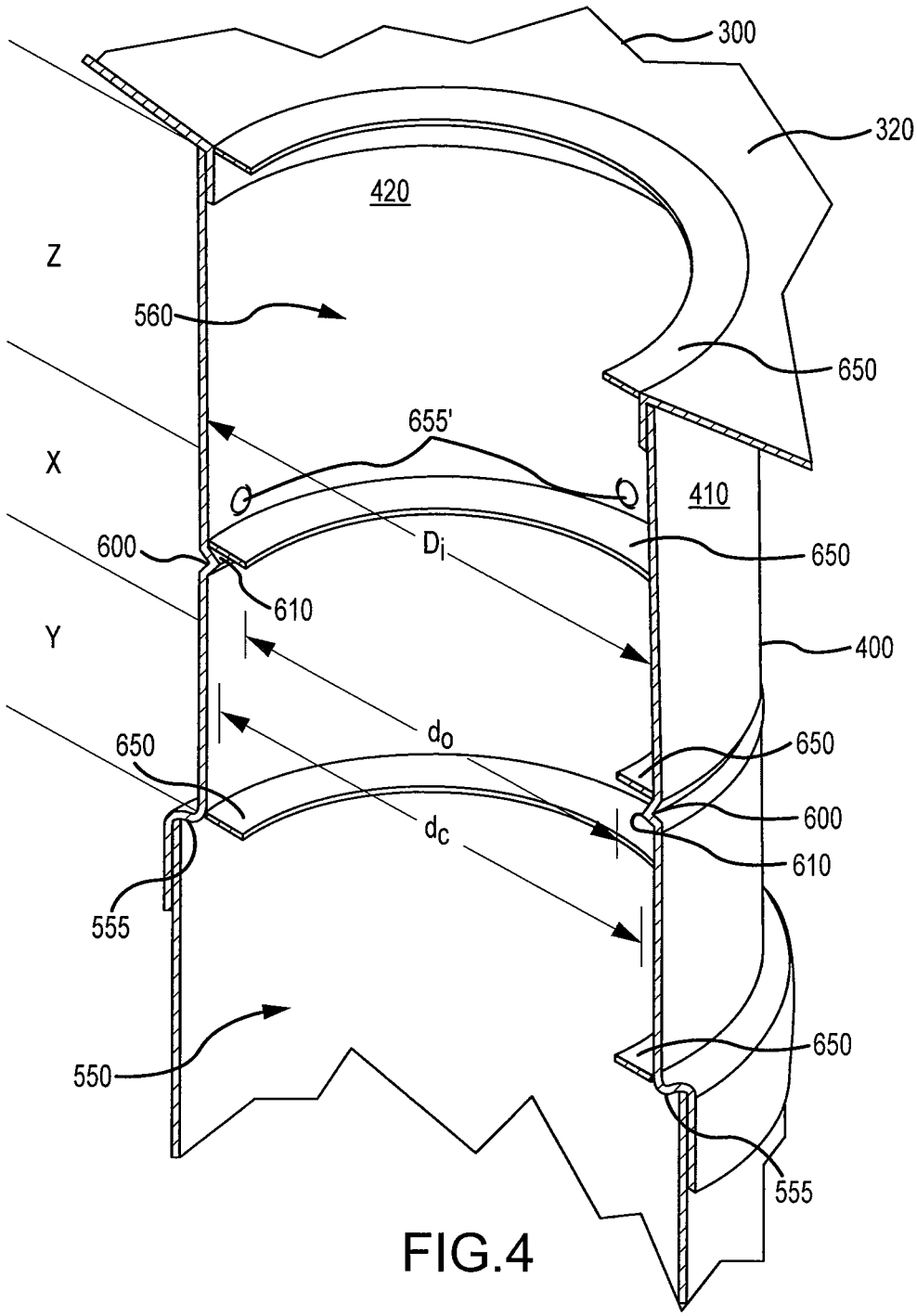
FIG. 4 shows alternative positions of the orifice ring within the upper combustion chamber.

FIGS. 2 and 3 show a constriction 600 or orifice ring 650 positioned at or near the middle region of the upper combustion chamber 560. In other embodiments, constrictions 600 or orifice rings 650 may be positioned other than the middle. Referring now to FIG. 3, the middle of the upper combustion chamber is designated "X," the lower portion, "Y", and the upper portion, "Z." In other embodiments, as depicted in FIG. 4, multiple constrictions 600 may be positioned throughout the upper combustion chamber 560. In other embodiments, as shown in FIG. 4, an orifice ring 650 may be positioned proximal the boundary 555 and lower combustion chamber 550 (marked as region "Y"), and/or at or near the top of the upper combustion chamber 560 (marked as region "Z), proximal the combustion chamber outlet 520.

Various embodiments may include multiple constrictions 600, orifice rings 650, or combinations thereof positioned within the upper combustion chamber 560. In some embodiments the multiple constrictions 600 and/or orifice rings 650 may define the same $d_o$, in other embodiments the $d_o$s may be different. In still further embodiments the orifice rings may be arranged to define converging or diverging nozzles. In still further embodiments it may be possible to alter the $d_o$ or the size of constrictions 600 or orifice rings 650 to affect damping or control vortex formation.

In various embodiments with multiple constrictions 600, the multiple constrictions 600 may define multiple constriction diameters, $d_c$. In further embodiments with multiple constrictions 600, constrictions 600 and orifice rings 650 maybe combined. In some embodiments the upper combustion chamber may be other than cylindrical, for example, without limitation, the upper combustion chamber may be square.

In various embodiments of the orifice ring 650, the ring or plate may be removable or replaceable within the upper combustion chamber 560. Replacement of orifice rings 650 may be aided by use of, for example without limitation, snap-fittings, press-fittings, and friction fittings. FIGS. 2 and 4 depict orifice rings 650 held in place, at least in part by a plurality of protrusions 655 extending radially inward from the wall of the upper combustion chamber 560. The protrusions 655 depicted in FIGS. 2 and 4 are positioned above the orifice ring 650 or plate to aid in holding it in place against the annular ridge 610 positioned below the orifice ring 650. In other embodiments the protrusions 655 may be positioned below the orifice ring 650 or plate and the annular ridge 610 may be positioned above the orifice plate 650. In further embodiments, the orifice ring 650 may be supported below and above by protrusions 655, or by annular ridges 610. In various other embodiments, the orifice ring 650 may be welded in place and otherwise not easily removable.

Experiments have shown that an orifice ring positioned within the upper combustion chamber will reduce CO by a significant amount, such as by 25% in some instances, and by 70% in other instances. Depending on the design of the combustion chamber and the fuel used, the results may vary.

Figure 5:
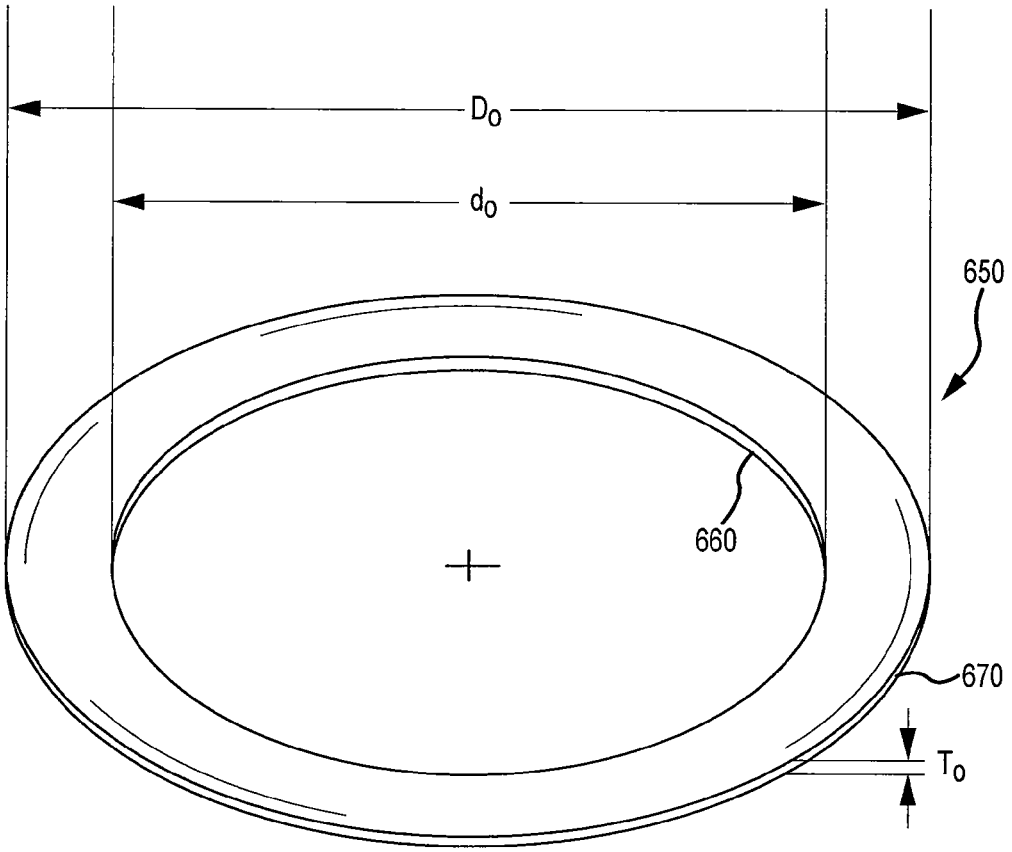
FIG. 5 depicts the current embodiment of the orifice plate.

FIG. 5 shows the orifice ring 650 alone. The orifice ring 650 may define a generally flat annular ring that includes an inner (central) edge 660 and an outer (peripheral) edge 670. The diameter of the outer edge 670 of the orifice ring 650, depicted by the letter "$D_o$," approximates the internal diameter of the upper combustion chamber 560 such that the orifice plate 650 may contact and/or fit close against the interior of the combustion chamber 500. The inner edge 660 defines the orifice diameter denoted by "$d_o$," and may further define an edge that is concentric and co-planar to the outer edge 670. The inner edge 660 and the outer edge 670 thus define a flat, un-broken annular surface that is of generally constant width. One present embodiment of the orifice ring 650 has a ratio of $d_o/D_o$ 0.75, while in other embodiments different ratios may also be used. In one present embodiment the thickness, $T_o$, of the orifice ring 650 is 0.5 mm. In other embodiments the orifice ring 650 may be thicker or thinner.

Figure 6:
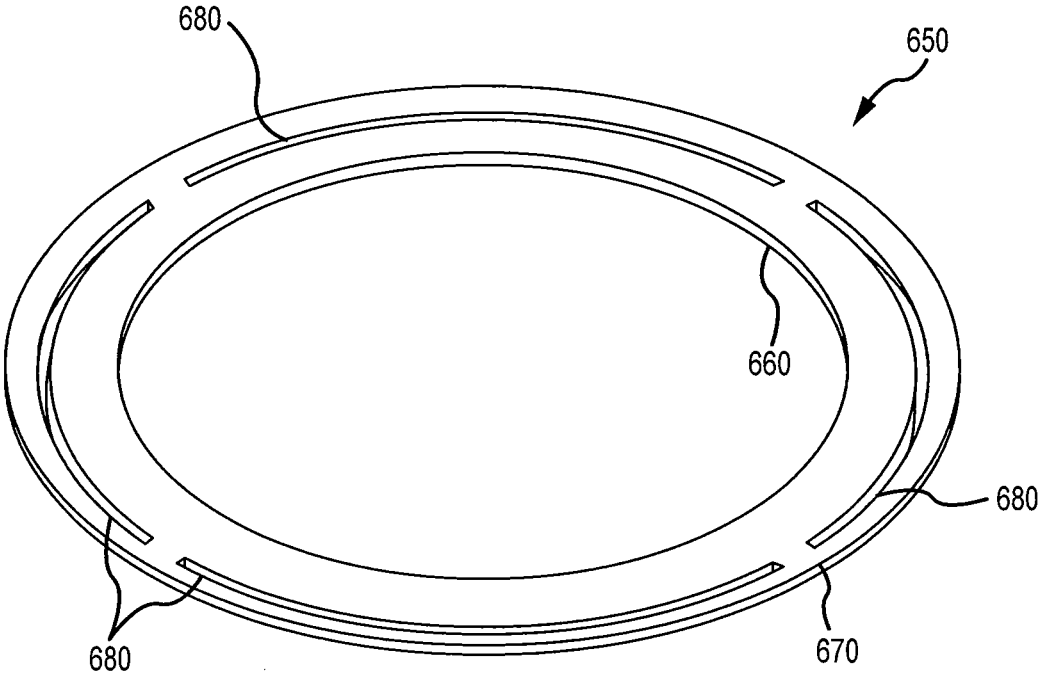
FIG. 6 is an alternative embodiment of the orifice ring.

The orifice ring 650 may be designed to slow heat transfer from the inner edge of the orifice ring 650 to the outer edge 670 of the orifice ring 650. In various embodiments of the orifice ring 650, as shown in FIG. 6, the ring may include a plurality of discontinuous circumferential slots 680 in the plate surface between the inner and outer edges 670. The slots 680 may be designed to retard heat conduction/transfer from the inner edge 660 of the orifice ring 650 to the outer edge 670. The circumferential slots 680 may, or may not, be formed all the way through the orifice ring 650, for example the slots 680 may be defined by indentations of the orifice ring 650 where the thickness is generally less than the thickness of the plate in other areas. The slots 680 as shown here, are nearer the outer edge 670 than the inner edge 660, however placement of the slots 680 may vary, and slots 680 on the same orifice ring 650 may also be placed in different locations on the ring surface.

Figure 7A:
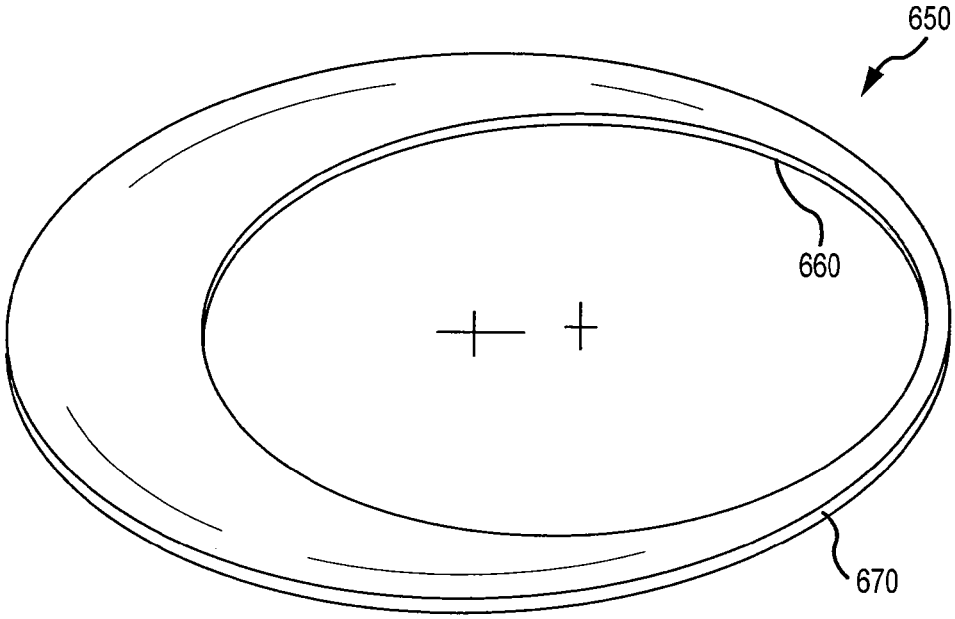
FIGS. 7A and 7B show alternative embodiments of the orifice ring.
Figure 7B:
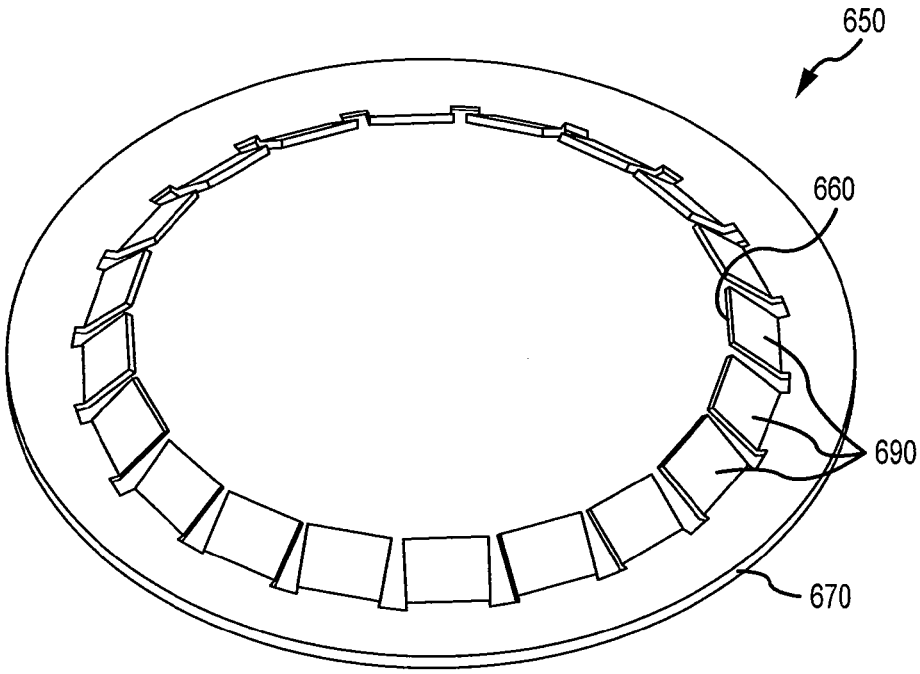

FIGS. 7A and 7B show further embodiments of the orifice plate 650. In some embodiments, as depicted in FIG. 7A, the orifice plates 650 have an inner edge 660 that is not concentric with the outer edge 670, and where the width of the plate surface is not generally constant. Embodiments such as that shown in FIG. 7A may aid in redirecting the flow of exhaust, for example without limitation, from the edge of the upper combustion chamber 560 into the center. As shown in FIG. 7B, other embodiments of the orifice plate 650 may be frustoconically shaped, and may include an inner edge 660 that defines a plurality of separated tabs 690 that extend radially inward. In still further embodiments of the orifice plate 650 the inner edge 660 may be serrated or discontinuous. Embodiments of the orifice plate 650 may also include edges that are not co-planar, for example, the inner ring may be positioned generally above the plane defined by the outer edge 670, or the inner ring may define a plane that is below the plane of the outer edge 670, or the plane defined by one edge may intersect the plane defined by the other edge. Additional embodiments may include an orifice plate 650 where either or both edges, do not define a single plane, or a plane at all, but may define a wave-like structure. In other embodiments the orifice ring 650 may include edges that are both discontinuous, for example without limitation, where the orifice plate 650 may define a spiral or corkscrew shape. Further orifice ring embodiments may have a combination of characteristics, for example without limitation, the outer edge may be continuous while the inner edge is discontinuous and defines a non-planar corkscrew shape.

Figure 8:
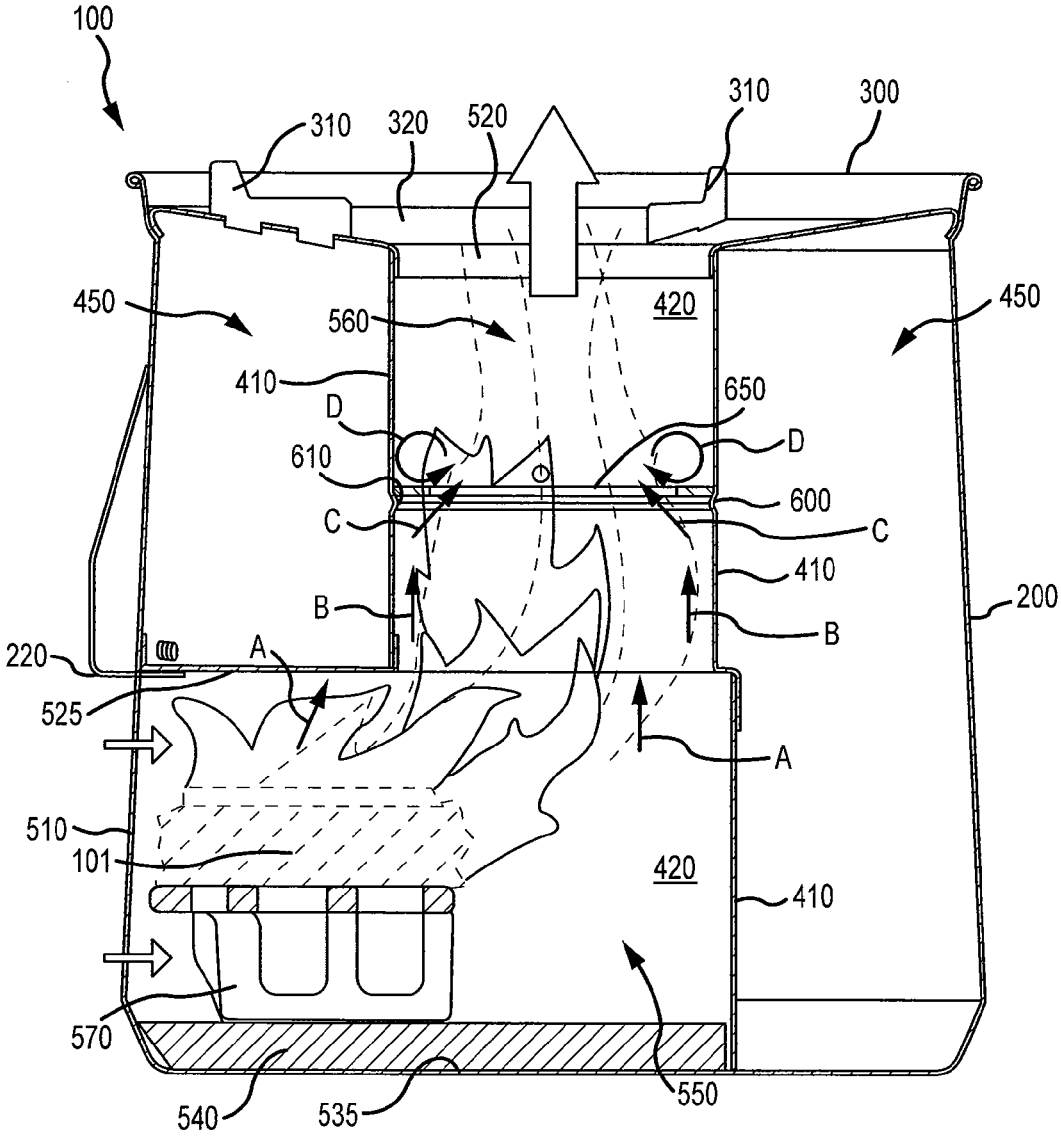
FIG. 8 is a sectional view of a stove in use with fuel being burned in the combustion chamber.

FIG. 8 shows the stove 100 with fuel 101 burning in the combustion chamber 500. In use, a fire built in the lower combustion chamber 550 may draw air (small unfilled arrows) into the combustion chamber 500 through the combustion chamber inlet 510 at the mouth 220. In some embodiments a door (not shown) may be positioned to reduce the area of the mouth 220 in order to regulate the amount of air entering the combustion chamber 500. Within the lower combustion chamber 550 the air may mix with gasses from the fuel 101 to promote combustion. In other embodiments the fuel may be heated to release gasses, as in gasification stoves. Exhaust from gasification or direct combustion (shown with solid arrows labeled "A," and comprising entrained air, uncombusted gases, incompletely combusted gases, combusted gases, and particulate matter) rises up through the lower combustion chamber 550 into the upper combustion chamber 560. Within the upper combustion chamber 560, combustion may be quenched by the lower temperatures proximal the wall of the upper part. The gases from the quenched combustion, containing uncombusted and incompletely combusted gases such as carbon monoxide, continue to rise up through the upper combustion chamber 560 (depicted by arrows labeled "B"). When these incompletely or uncombusted gases reach the orifice ring 650 they are redirected toward the center of the flames and may then undergo combustion in the higher temperature or by passing through or into the flame (depicted by arrows labeled "C"). Additionally, incompletely combusted gases that are not consumed by the fire may linger in the upper combustion chamber 560 by the action of the turbulence front set up by and above the orifice ring 650 (depicted by arrows labeled "D"). Recirculation of the incompletely combusted gases in the region above the orifice ring 650, depicted by arrow "D," creates more opportunity for uncombusted gases to be combusted by the high temperatures or by passing into the flames. Finally, exhaust (depicted as single large unfilled arrow) exits the combustion chamber 500 at the combustion chamber outlet 520 defined by the opening in the cooktop 300. After exiting the combustion chamber outlet 520, it may be directed at a cooking vessel positioned above the outlet 520.

In some applications, as explained above, the upper combustion chamber 560 may act as a heat sink and act to at least partially quench combustion of gases near the interior wall of the combustion chamber 500. The orifice plate 650 may aid in helping redirect these gases back into the flame (arrows marked "C"), increasing the chance that they will undergo combustion. The inner edge 660 of the orifice ring 650 may be designed to become very hot to aid in promoting combustion of uncombusted gases flowing thereby. In addition, the orifice ring 650 creates a disruption in the flow of gases above the ring, such as by creating a turbulence zone (see arrows marked "D" in FIG. 8) and thus impeding or delaying their travel through the combustion chamber 500, thus also increasing the likelihood that they will also be consumed by the flame before leaving the combustion chamber 500. In various embodiments, quenching may also be reduced by introduction of insulation material into the cavity 450.

As depicted in FIGS. 1, 2, and 8, a cooktop 300 may be positioned above and in communication with the combustion chamber outlet 520 in order to receive a cooking vessel (not shown) and position that vessel to be heated by the heated exhaust. The cooktop 300 may further include a plurality of structures 310 designed to support the cooking vessel above the cooktop surface 20 and over the combustion chamber outlet 520. The position of the combustion chamber outlet 520, cooktop 300, and support structures 310 directs the exhaust to the underside of the cooking vessel to facilitate efficient heating of the cooking vessel.

Figure 9A:
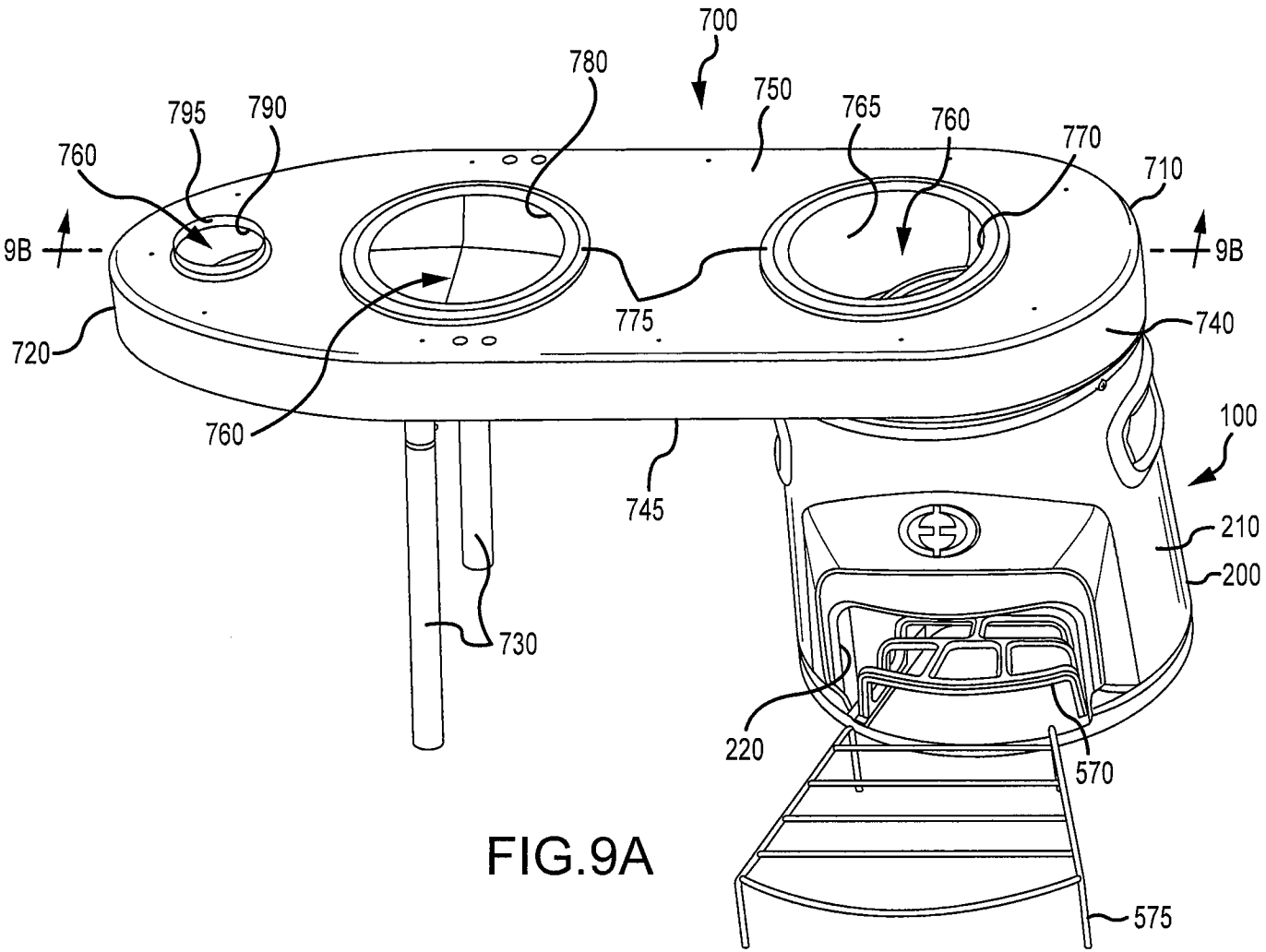
FIG. 9A shows an alternative embodiment of the stove where a dual burner cooktop installed, also shown is an external grate to aid in supporting twigs, branches, and other long pieces of biomaterial.
Figure 9B:
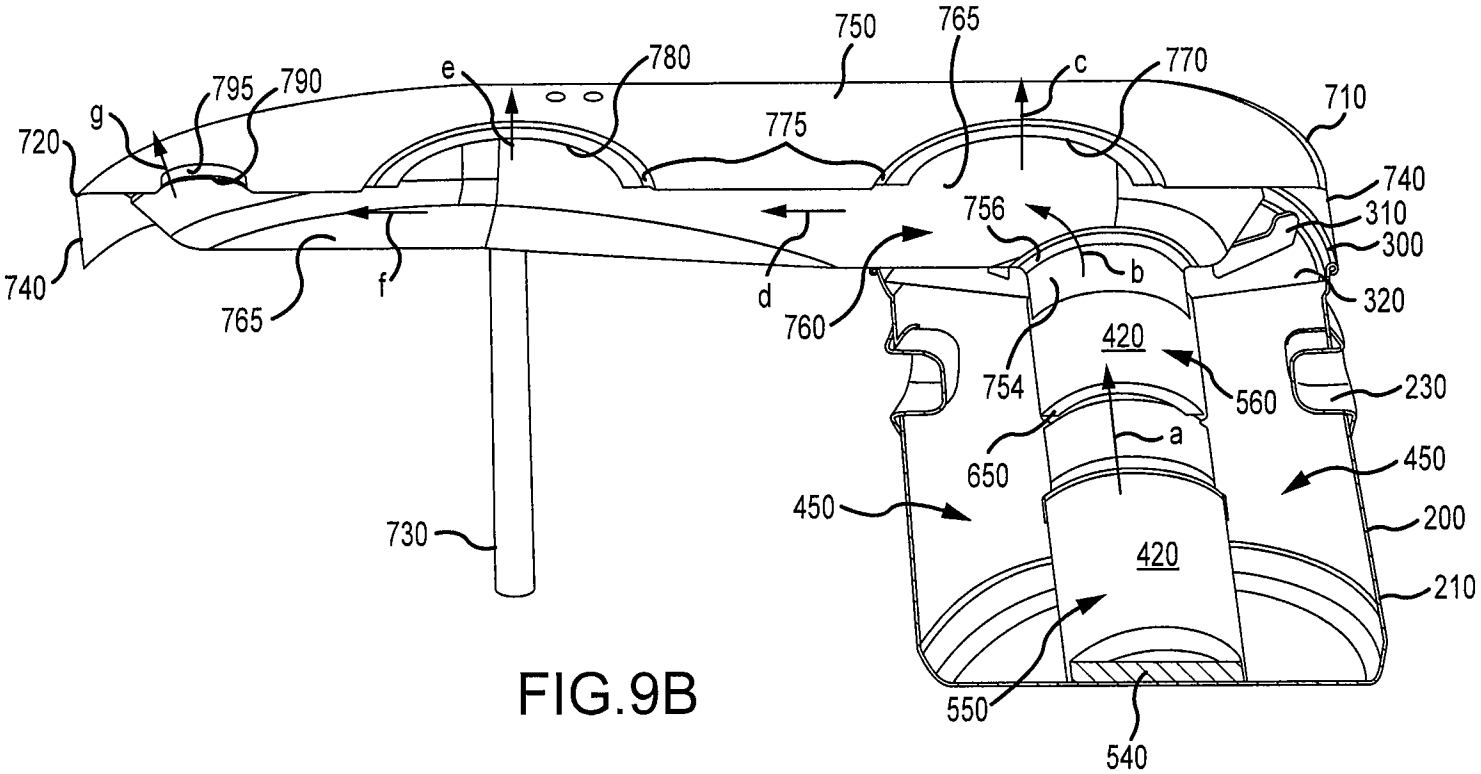
FIG. 9B section taken through line 9B-9B of FIG. 9A, and shows the flow path of the combustion materials through the dual burner cooktop.

FIG. 9A shows an alternative embodiment of the stove 100 wherein the dual burner cooktop 700 is designed to support two cooking vessels simultaneously. FIG. 9B is a sectional view of the stove 100 in FIG. 9A. The dual burner cooktop 700 defines a generally elongated structure, having an elliptical-like shape. The dual burner cooktop 700 has two ends; a first rounded end 710 of the dual burner cooktop 700 is positioned above the stove 100, and a second tapered end 720 of the dual burner cooktop 700 extends away from the stove 100. The tapered end 720 positioned away from the stove 100 may be supported by legs 730 attached at or near the tapered end 710 of the dual burner cooktop 700, which extend down to contact the ground. The legs 730 are sufficiently long to support the dual burner cooktop 700 in a horizontal, and generally planar position. The dual burner cooktop 700 defines a generally flat surface 750. At the edge of the cooktop surface 750, an apron 740 extends downward. The lower edge 745 of the apron 740 is designed to rest upon the cooktop 300 of the stove 100 and provide protection from contact with a dual burner liner 765 described below. Other means for supporting the dual burner cooktop 700 are contemplated. In further embodiments, for example without limitation, supports such as a leg or legs may be positioned at or nearer the second end.

The cooktop surface 750 may define three openings, which may be in communication with an exhaust chamber 760 defined by the underside of the cooktop surface 750 and the liner 765. A first opening 770 may be positioned near the rounded end 710. A second opening 780 may be positioned near the middle of the dual burner cooktop 700, and a third opening 790 may be positioned near to the elongated end 720. The first 770 and second 780 openings may be surrounded by annular ridges 775 designed to support a cooking vessel. The third opening 790 may define a collar 795. The third opening 790 is smaller than the first 770 and second opening 780, and acts as an exhaust outlet. The collar 795 of third opening 790 radiates upward from the cooktop surface 750 and may be designed to receive a stovepipe or vent (not shown). The annular ridges 775 of the first 770 and second opening 790 extend upward from the cooktop surface 750 and are generally concentric to the openings.

FIG. 9B shows a cutaway of the dual burner cooktop 700 showing exhaust gases as they travel from the lower combustion chamber 550 through the stove 100 into and through the dual burner cooktop stove 700. The exhaust chamber 760 may be defined by the liner 765 and under surface of the cooktop. The liner 760 defines an opening 756 that is designed to fit with the combustion chamber outlet 520. The liner opening 756 further defines a sleeve 754 that extends downwardly into the upper combustion chamber 560 of the stove 100. When engaged, the sleeve 754 extends into the upper combustion chamber 560 so that the upper combustion chamber 560 may be in communication with the exhaust chamber 550. The diameter of the liner opening 756 may be smaller than the interior diameter, $D_i$, of the upper combustion chamber 560. The exhaust chamber 760 may help to direct the exhaust from the combustion chamber 760 to the first 770 and second 780 openings in the cooktop surface 750 where it may be used to heat a cooking vessel positioned above those openings. The exhaust not passing through the first 770 and second 780 openings may then exit the exhaust chamber 760 by way of the third opening 790 in the cooktop surface 750. Alternative embodiments may have more or fewer openings used for cooking formed in the extended cook top surface.

Arrows in FIG. 9B show the path of heated exhaust product as it: "a"—travels to the upper combustion chamber 560; "b"—passes through the exhaust chamber opening 756 defined by the sleeve 754 and into the exhaust chamber 760 of the dual burner cooktop 700; "c"—leaves the exhaust chamber 760 through the first opening 770; "d"—travels through the exhaust chamber 760; "e"—leaves the exhaust chamber 760 through the second opening 780; "f"—continues through the exhaust chamber 760; and "g"—leaves the exhaust chamber 760 through the third opening 790.

Figure 10:
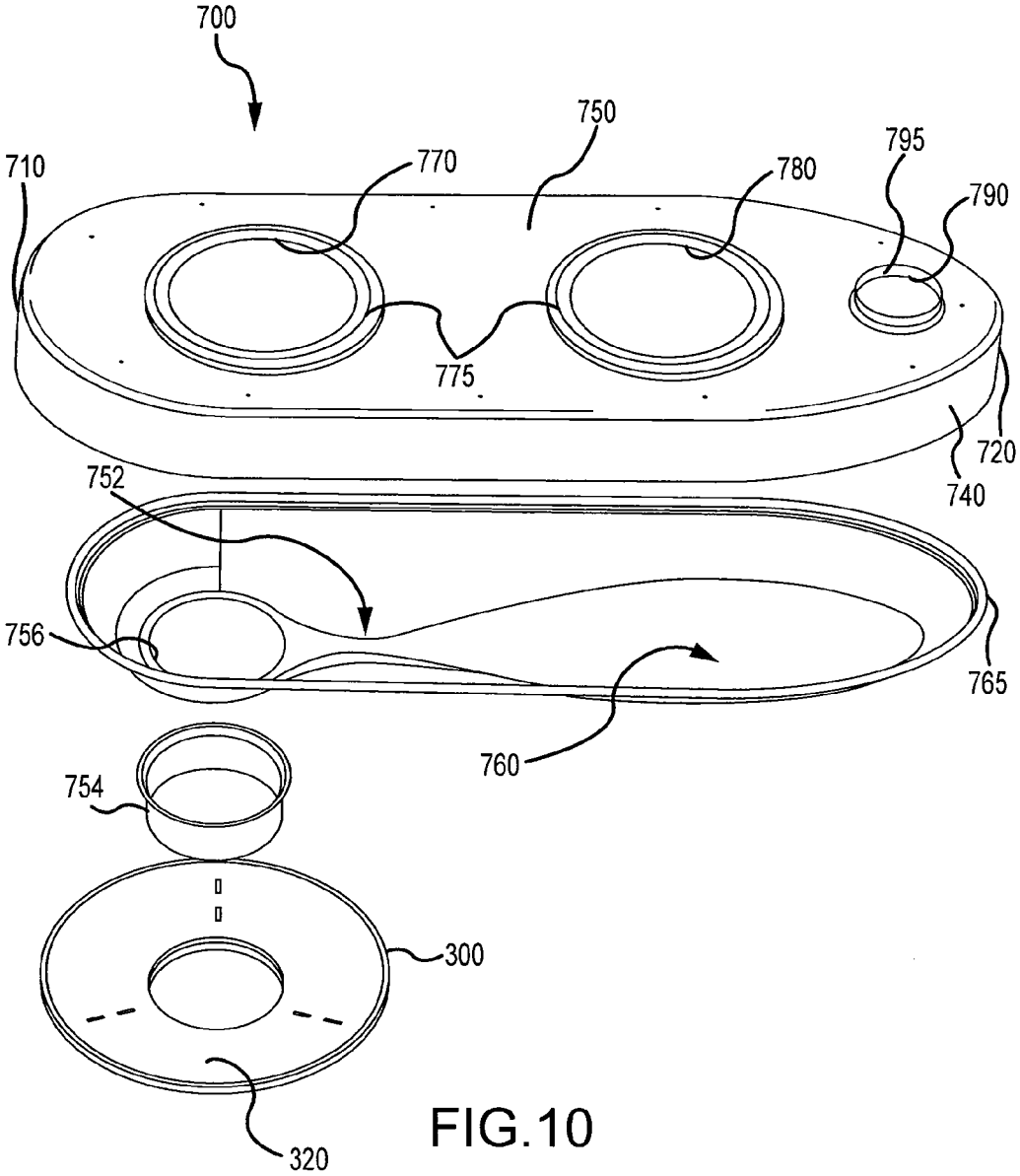
FIG. 10 is a detailed exploded view of the dual burner cooktop.

FIG. 10 shows an exploded view of the dual burner cooktop 700, liner 760, sleeve 754, and stove cooktop 300. Here can be seen the interior shape of the exhaust chamber 760 and a narrow channel 752 in the exhaust chamber 760 defined by the liner 765 between the first 770 and second openings 780. The narrow channel 752 helps direct the exhaust gases toward the openings.

FECRAL

In various embodiments of the stove, the combustion chamber may be clad in FeCrAl. FeCrAl is a metal alloy containing iron, chromium, aluminum, and other elements in varying ratios depending on the intended purpose. FeCrAl is known in the art to be resistant to corrosion in both reductive and oxidative environments. FeCrAl may form two oxide layers, one iron and another of aluminum that help guard against corrosion. Normally used for its electrical resistivity characteristics, FeCrAl is typically not used for applications with high temperatures where structural load is applied because of its poor structural performance at high temperatures. For example, FeCrAl alloys may have a very high melting point (>1000° C.) and easily forms stable aluminum oxides which resist corrosion. When used as part of the combustion chamber of the present invention, FeCrAl performs well.

The present embodiment uses FeCrAl to form, line, or clad the combustion chamber as well as to form the orifice ring (if present). In at least one embodiment, the wall thickness of the combustion chamber may be 0.7 mm. Further embodiments may possess combustion chamber wall thicknesses greater than 0.7 mm or less than 0.7 mm, such as without limitation, 0.5 mm. In some embodiments the wall thickness of the upper portion of combustion chamber may be from 0.5 to 0.3 mm. In further embodiments the wall thickness of the upper combustion chamber may be less than 0.3 mm. In various embodiments the thickness of walls in the upper chamber may differ from the wall thickness in the lower chamber. In some embodiments, the thickness of the combustion chamber walls may vary. Use of this inexpensive, corrosion-resistant metal alloy allows production of an inexpensive, long-lasting, corrosion-resistant alternative to ceramics or specialized metals. Use of FeCrAl alloy may allow the construction of an inexpensive metal combustion chamber for biomass stoves as opposed to a combustion chamber of other metals or ceramics which are heavier and more problematic when manufacturing and shipping stoves. The reduced mass may also allow for faster heating of the chamber, reducing emissions and improving efficiency.

The ratio of compounds within the alloy may be changed depending on the desired application. For example, one FeCrAl alloy embodiment may contain a mixture of Al (~5-15%), Cr (~3-8%), and Fe (balance). Another embodiment may have a weight percent ratio of 13% Chromium:4% Aluminum, with the balance being mostly Iron. Other ranges include Al (2%-8%): Cr (10%-20%): Other (<1%): and Fe (Balance). In other embodiments the ratios of chromium, aluminum, iron, and other elements may vary.

In various embodiments, the FeCrAl may contain carbon, titanium, or zinc. In some embodiments, the FeCrAl may contain less than 0.1% carbon. In embodiments where FeCrAl contains less than 0.1% carbon, the FeCrAl may further comprise titanium. In embodiments with FeCrAl containing carbon and titanium, the titanium may be less than 1%. In some embodiments, the FeCrAl may contain about 0.08% or less of carbon and about 0.5% titanium. In various embodiments, titanium may help increase the oxidation resistance of FeCrAl containing carbon. FeCrAl may have the trade name FECRALLOY, OHMALOY (manufactured by Allegheny Ludlum), or KANTHAL. In the present embodiment, the orifice ring may also be constructed of FeCrAl. In other embodiments, the orifice ring may be constructed of other suitable materials.

Figure 11:
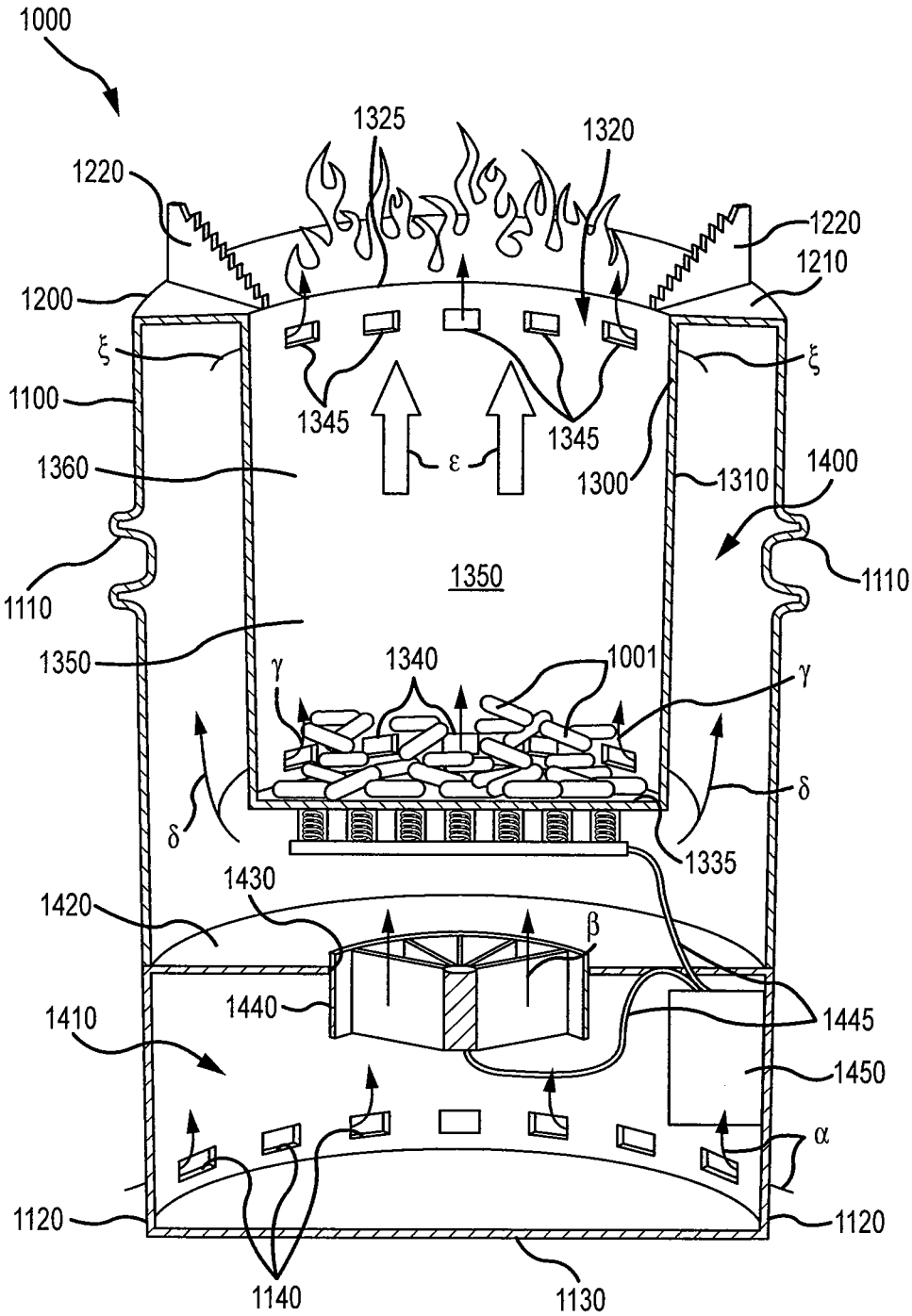
FIG. 11 shows an alternative stove embodiment that may employ the inventive disclosures.

FIG. 11 shows an alternative embodiment of a portable biomass stove 1000. This stove 1000 embodiment is comprised of an exterior shell 1100, a cooktop 1200, and a liner 1300. The shell 1100 may further include handles 1110, a base 1120, and a generally flat bottom 1130 for supporting the stove on the ground or other suitable surface. The cooktop 1200 may include a cooktop surface 1210 and a plurality of support structures 1220 for supporting a cooking vessel above the cooktop 1210. The liner 1300 is further comprised of an interior surface 1305 and an exterior surface 1310. Positioned between the shell 1100 and the exterior surface of the liner 1310 is a cavity 1400. The liner 1300 may define a combustion chamber 1320 that is generally cylindrical and opens through the cooktop 1200 at a combustion chamber outlet 1325. The combustion chamber may be comprised of a lower combustion chamber 1350 and an upper combustion chamber 1360. The lower combustion chamber 1350 may include a floor 1335 that may be designed to hold solid biomass fuel 1001.

Positioned at the base 1120 of the stove 1000 may be a plurality of apertures 1140 in the shell 1100. The apertures 1140 may open into an intake chamber 1410 defined by the bottom of the shell 1100 and a divider 1420, which divides the cavity 1400. The divider 1420 may define an opening 1430 into which may be placed a fan 1440. The fan 1440 may be connected to a wire(s) 1445, which are in turn connected to a battery 1450 or other device to provide electricity to the fan 1440. The fan 1440 may aid in drawing air through the apertures 1140 into the intake chamber 1410. The fan 1440 may further force air from the intake chamber 1410 into the cavity 1400 above the divider 1420. The battery 1450 may also be connected by wire(s) 1445 to a heating element 1330. The heating element 1330 may aid in heating solid biomass fuel 1001. The heated solid biomass fuel 1001 may give off volatile gases that mix with air that may be forced or drawn in from the cavity 1400 that may enter the combustion chamber 1320 through a plurality of inlets 1340 positioned near the floor 1335 of the lower combustion chamber 1350. Air from the cavity 1400 may also enter the combustion chamber 1320 through a second plurality of inlets 1345 positioned near the top of the upper combustion chamber 1360. In some embodiments a plurality of doors (not shown) may be movably and selectively positioned over the apertures and/or inlets to reduce the area of these openings and aid in regulation of the amount of air entering the combustion chamber.

When the stove in FIG. 11 is in use, air is drawn into the cavity 1400 at the intake chamber 1420 (arrows marked "a") through a plurality of apertures 1140, at least partially by the action of the electric fan 1440. In some embodiments the fan may have variable speed to help regulate the flow of air. The air may pass through the fan 1440 (arrows marked "β") and be forced toward the liner 1300. Some of the air may travel up the cavity, through the inlets 1340, and into the lower combustion chamber 1350 (arrows marked "γ"), where the air γ may mix with volatile gases from the heated solid biomass fuel 1001 to form a combustible gas (large empty arrows marked "ϵ"). Some air may travel further up the cavity (arrows marked "δ"). Some air may enter the combustion chamber 1320 through the inlets 1345 positioned near the top of the upper combustion chamber 1360 (arrows marked "ζ"). The air ζ entering at the top of the combustion chamber 1360 may mix with the combustible gas ϵ rising up from the lower combustion chamber 1350, and when ignited may form a flame. This flame may be used to heat a cooking vessel positioned above the outlet.

In the embodiment shown in FIG. 11, fuel may be added in batches through the combustion chamber outlet. Further, in this embodiment the combustion chamber may be lined, clad, or formed of FeCrAl while the shell may be manufactured from some other material. The use of FeCrAl in the combustion chamber beneficially allows the combustion chamber to better withstand the very high temperatures and corrosive effects of the combustion process, such as in a gasification stove. Use of FeCrAl may allow the presently disclosed cook stove to last longer than with typical materials such as stainless steel. FeCrAl will also allow production of a less expensive stove by reducing costs associated with stoves that use combustion chambers made of other materials such as ceramics.

Example 1

Thermal efficiency and particulate matter production was analyzed in cookstoves with and without an orifice ring. In this experiment the amount of time needed to boil water was measured along with the amount of wood used and particulate matter produced for each stove. Results from the tests were used to calculate thermal efficiency for biomass stoves with and without an orifice ring.

TABLE 1

Table I

| | CO (g) | PM (mg) | Wood Use (g) | Time to Boil (min) | Thermal Efficiency |
|---|---|---|---|---|---|
| ElBv10 (shortened elbow 3" orifice) | 15.4 | 529 | 449.1 | 31.5 | 40.1 |
| ElBv11 (shortened elbow no orifice) | 20.5 | 1518 | 463.1 | 34.5 | 31.3 |

Table 1 shows experimental results of stove performance with and without an orifice during a three phase modified water boil test. Wood was used as a bio-mass source. Carbon monoxide (CO) emissions are measured in grams, particulate matter (PM) is measured in milligrams, wood use in grams. The results presented in Table 1 show that the presence of an orifice ring led to decreased CO and PM production from the stove while increasing thermal efficiency.

Example 2

The effect on carbon monoxide (CO) production of stoves with and without an orifice ring was tested using the Testo system. This experiment used a FeCrAl 100 mm standard rocket stove having an elbow. From a cold start, the tests showed that the orifice plate resulted in a 2.51 g of CO produced while the rocket elbow without the orifice plate resulted in production of 8.5 g of CO. CO production was measured by Fourier transform infrared (FITR) spectroscopy.

All directional references (e.g., upper, lower, upward, downward, left, right, leftward, rightward, top, bottom, above, below, inner, outer, vertical, horizontal, clockwise, and counterclockwise) are only used for identification purposes to aid the reader's understanding of the example of the invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

It will be apparent to those of ordinary skill in the art that variations and alternative embodiments may be made given the foregoing description. Such variations and alternative embodiments are accordingly considered within the scope of the present invention.

What is claimed is:

1. A portable biomass fuel stove comprising:

a main body including an inner chamber forming a combustion chamber, said combustion chamber further comprising;

a lower combustion chamber for combustion of the solid biomass fuel, said lower combustion chamber having at least one inlet for air to pass through; and an upper combustion chamber for channeling exhaust out of the combustion chamber;

wherein the combustion chamber is at least partially load bearing and at least one of the upper combustion chamber and the lower combustion chamber is formed of an alloy comprising FeCrAl.

2. The stove of claim 1, further comprising an orifice ring positioned within the upper combustion chamber.

3. The stove of claim 2, wherein the orifice ring is comprised of FeCrAl.

4. A portable biomass stove comprising:

a main body including;

a shell, with a plurality of handles;

an inner chamber forming a combustion chamber, said combustion chamber including;

a lower combustion chamber for at least partially containing the biomass fuel and including at least one inlet for the passage of at least air into the combustion chamber, and an upper combustion chamber having at least one outlet for venting at least part of any combustion byproducts away from said lower combustion chamber; and at least one annular constriction positioned in said upper combustion chamber, said constriction defining an aperture through which combustion byproducts flow, and through which an open flame may extend, said annular constriction to redirect at least a portion of any combustion byproducts upstream of said annular constriction back into the open flame combustion, and to create a recirculation zone downstream of said annular constriction to increase residence time of said combustion byproducts and to redirect at least a portion of said combustion byproducts back into the open flame combustion extending through said annular constriction; and wherein said combustion chamber is at least partially load bearing and at least one of the upper combustion chamber and the lower combustion chamber is formed of an alloy comprising FeCrAl.

5. A stove as defined in claim 4, wherein:

said annular constriction is an orifice ring defining an outer periphery adjoined to the upper combustion chamber and an inner periphery defining said aperture.

6. A stove as defined in claim 5, wherein said inner periphery of said orifice ring defines separated tabs.

7. A stove as defined in claim 5, wherein said aperture is centered in said ring.

8. A stove as defined in claim 5, wherein said ring is flat.

9. A stove as defined in claim 5, wherein said ring is frustoconically shaped.

10. A stove as defined in claim 5, wherein a slot is formed between said inner edge and said outer edge, and extends at least part of the circumference around said ring.

11. A stove as defined in claim 5, wherein said ring is positioned in said upper combustion chamber is adjacent said lower combustion chamber.

12. A stove as defined in claim 5, wherein said ring is positioned in said upper combustion chamber is distal from said lower combustion chamber.

13. A stove as defined in claim 5, wherein more than one ring is positioned in said upper combustion chamber.

14. A stove as defined in claim 4, wherein said upper combustion chamber is formed of an alloy comprising FeCrAl.

15. A stove as defined in claim 4, wherein said lower combustion chamber and said upper combustion chamber are formed of an alloy comprising FeCrAl.

16. The stove of claim 4, wherein the FeCrAl comprises:

carbon of about 0.03% or less by weight; and titanium of about 0.5% by weight.

17. A portable biomass fuel stove comprising:

a shell; comprising a plurality of handles for lifting and transporting the stove, a bottom for supporting the stove on the ground, the shell further defining a inlet and an outlet;

a cooktop positioned at the outlet configured to accept and support a cooking vessel above said outlet; and a combustion chamber for containing and combusting solid biomass fuel, wherein the combustion chamber is metal, and comprises an upper combustion chamber and a lower combustion chamber;

wherein the combustion chamber includes at least one annular constriction positioned in said upper combustion chamber, said constriction defining an aperture through which combustion gases and byproducts flow, and through which an open flame may extend, said annular constriction to redirect at least a portion of any gases and combustion byproducts upstream of said annular constriction back into the open flame combustion, and to create a recirculation zone downstream of said annular constriction to increase residence time of said combustion by products and to redirect at least a portion of said combustion byproducts back into the open flame combustion extending through said annular constriction; and wherein the combustion chamber is at least partially load bearing and at least one of the upper combustion chamber and the lower combustion chamber is formed of an alloy comprising FeCrAl.

* * * * *